US010072673B2

(12) United States Patent
Eddie

(10) Patent No.: US 10,072,673 B2
(45) Date of Patent: Sep. 11, 2018

(54) COMPRESSOR SYSTEM

(71) Applicant: The Scott Fetzer Company/Powerex Division, Harrison, OH (US)

(72) Inventor: Justinn B. Eddie, Harrison, OH (US)

(73) Assignee: Powerex-Iwata Air Technology, Inc., Harrison, OH (US)

( * ) Notice: Subject to any disclaimer, the term of this patent is extended or adjusted under 35 U.S.C. 154(b) by 4 days.

(21) Appl. No.: 14/815,405

(22) Filed: Jul. 31, 2015

(65) Prior Publication Data

US 2016/0032943 A1 Feb. 4, 2016

Related U.S. Application Data

(60) Provisional application No. 62/032,859, filed on Aug. 4, 2014.

(51) Int. Cl.

| | |
|---|---|
| ***F04D 29/60*** | (2006.01) |
| ***F04C 23/00*** | (2006.01) |
| ***F04D 29/66*** | (2006.01) |
| ***F01C 21/00*** | (2006.01) |
| *F04C 18/02* | (2006.01) |

(52) U.S. Cl.

CPC ..... *F04D 29/601* (2013.01); *F01C 21/007* (2013.01); *F04C 23/001* (2013.01); *F04D 29/668* (2013.01); *F04C 18/0215* (2013.01); *F04C 2270/12* (2013.01); *Y10T 137/7039* (2015.04)

(58) Field of Classification Search

CPC ..... A47B 88/40; A47B 88/403; A47B 88/423; A47B 2210/0018; F01C 21/007; F04C 23/001; F04C 2270/12; F04D 25/16; F04D 29/601; F04D 29/668; F25D 19/00; F25D 19/02; E02D 27/01; Y10T 137/6851; Y10T 137/6914; Y10T 137/7039

USPC ..... 137/343, 376, 899.4; 211/162; 248/298.1, 638, 678; 417/234, 360

See application file for complete search history.

(56) References Cited

U.S. PATENT DOCUMENTS

| | | | | | |
|---|---|---|---|---|---|
| 2,441,509 | A * | 5/1948 | Robinson | F16F 15/08 | 248/634 |
| 3,946,977 | A * | 3/1976 | Kuhfus | H04M 1/0297 | 248/126 |
| 4,278,726 | A * | 7/1981 | Wieme | A63C 5/075 | 188/382 |
| 5,277,554 | A * | 1/1994 | Elson | F04B 39/00 | 248/638 |
| 6,079,677 | A * | 6/2000 | Daoud | H02G 3/16 | 248/201 |
| 6,254,047 | B1 * | 7/2001 | Dedrick | B65D 90/006 | 248/298.1 |
| 6,397,883 | B1 * | 6/2002 | Huntley | H01L 21/67017 | 118/728 |

(Continued)

*Primary Examiner* — Mary McManmon
*Assistant Examiner* — Richard K Durden
(74) *Attorney, Agent, or Firm* — John A. Yirga, Esq.; Tarolli, Sundheim, Covell & Tummino LLP

(57) ABSTRACT

A gas compressor system is disclosed. The gas compressor system includes a dryer assembly, a receiver tank, and at least one support level. The at least one support level has two slide channels supported by two beams. A platform is slidably attached to the slide channels. An isolator is disposed between each of the slide channels and the beams. A compressor is mounted to each platform.

21 Claims, 6 Drawing Sheets

(56) References Cited

U.S. PATENT DOCUMENTS

| | | | | |
|---|---|---|---|---|
| 6,712,655 | B1 * | 3/2004 | Schlemmer | B63H 21/305 440/111 |
| 2005/0055917 | A1 * | 3/2005 | Dubensky | E04B 1/3483 52/302.1 |
| 2005/0063844 | A1 * | 3/2005 | Sato | F01C 21/007 417/423.5 |
| 2005/0206172 | A1 * | 9/2005 | Bacon | E05B 17/0004 292/216 |
| 2006/0254997 | A1 * | 11/2006 | Pellegrino | A47B 47/021 211/195 |
| 2007/0212235 | A1 * | 9/2007 | MacNeil | F04B 17/03 417/361 |
| 2009/0185929 | A1 * | 7/2009 | Duppert | F01C 21/007 418/55.1 |
| 2010/0269919 | A1 * | 10/2010 | Stopka | F04B 35/06 137/376 |
| 2012/0014817 | A1 * | 1/2012 | Hood | F01C 21/007 417/313 |

* cited by examiner

COMPRESSOR SYSTEM

CROSS-REFERENCE TO RELATED APPLICATIONS

The present application claims priority under 35 U.S.C. § 119(e) to U.S. Provisional Patent Application Ser. No. 62/032,859 filed Aug. 4, 2014 entitled COMPRESSOR SYSTEM. The above-identified provisional application incorporated herein by reference in its entirety for all purposes.

FIELD OF THIS DISCLOSURE

The present disclosure relates to a gas compressor system. More specifically, the present disclosure relates to a gas compressor system having vibration isolators and sliding features that enable easy access to components of the gas compressor system to facilitate system, preventive maintenance, repairs, and the like.

BACKGROUND

Compressor systems are used in the industry to provide compressed air and other gases to a wide variety of equipment. Several compressor systems may be combined together to form a single compressor system. The collection of compressors typically provides a prescribed volume of gas to supply an application (such as one or more machines or pieces of equipment) or to be stored in a pressure vessel. One arrangement for a compressor system is to provide multiple compressors vertically in a tower configuration.

The configuration of the tower is generally aimed at minimizing floor space and also maximizing ease of transportation and installation. Moreover, a collection of localized compressors in a tower configuration facilitates the concentration of noise, thus allowing the noise to be isolated in a designated area of the plant in which the compressors operate.

SUMMARY

One aspect of the present disclosure comprises a slide channel for use in a compressor system. The slide channel is part of a support level. The slide channel is supported by a beam. A platform is slidably attached to the slide channel, and a compressor is mounted to the platform.

Another aspect of the present disclosure comprises an isolator for use in the compressor system. The isolator is mounted between the slide channel and the beam. The isolator may be made of two different vibration isolation materials and may have a cuboid shape.

While yet another aspect of the present disclosure comprises method of accessing a compressor supported by a compressor system, the method comprises the steps of: providing at least one support level, the at least one support level having at least two slide channels; supporting the at least two slide channels with at least two beams; providing a platform for supporting a compressor, the platform slidably attached to the at least two slide channels, and disposing an isolator between each of the at least two slide channels and the at least two beams. The method also comprises the step of positioning at least one slot along each of the slide channels, each of the slots having first and second sliding fasteners for coupling the slide channel to the platform; removing the first sliding fastener from each of the slots; and loosening the second sliding fastener in each of the slots to allow relative movement of the platform from the beams to allow access to the compressor thereon.

In yet another aspect of the present disclosure comprises a gas compressor system comprising at least one dryer assembly; at least one receiver tank; and at least two support levels. Each of the two support levels includes at least two slide channels supported by at least two beams; a platform slidably attached to the at least two slide channels; an isolator disposed between each of the at least two slide channels and the at least two beams; and a compressor mounted to the platform. The gas compressor system further includes a slot that extends axially along each of the slide channels and that are parallel with one another, each slot further comprises a limiter positioned within each slot to form first and second portions of the slot. At least one removably located fastener is positioned within the first and second portions of the slot. Each of the removably located fasteners slidably secure the platform to the slide channels.

BRIEF DESCRIPTION OF THE SEVERAL VIEWS OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

Figure 4:
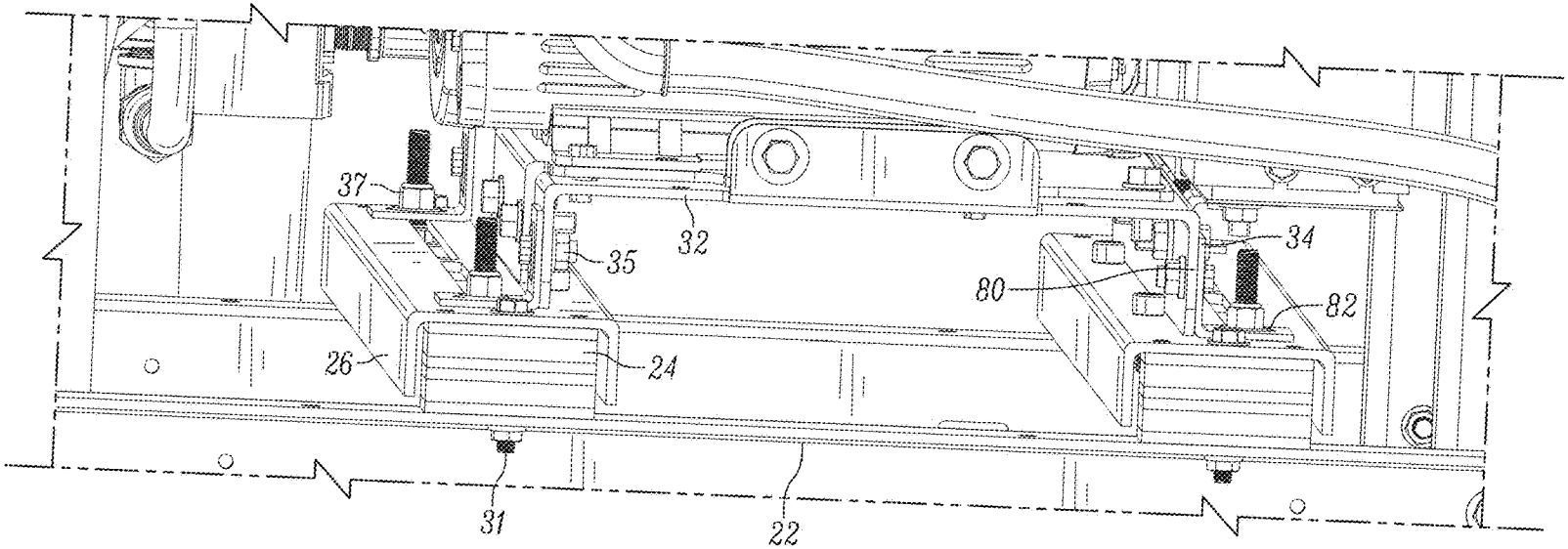
Figure 6:
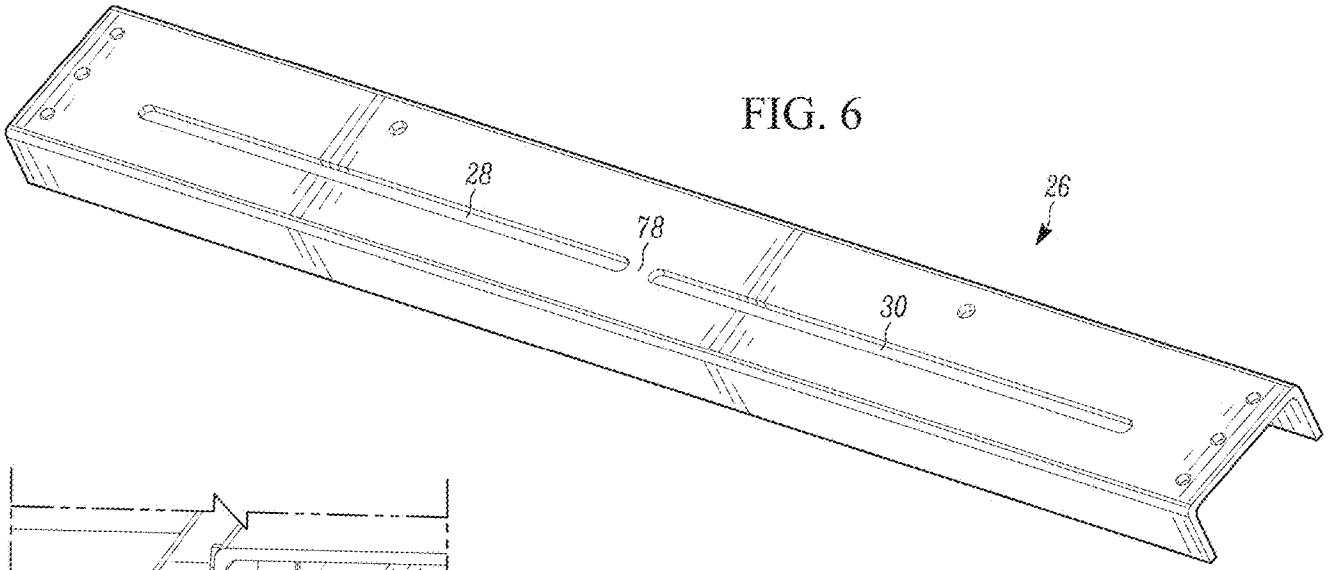
Figure 5:
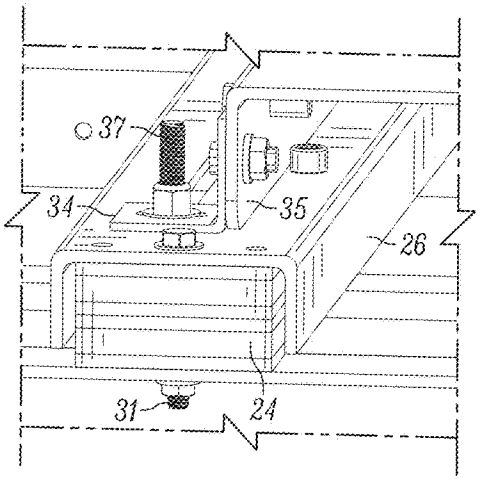
Figure 8:
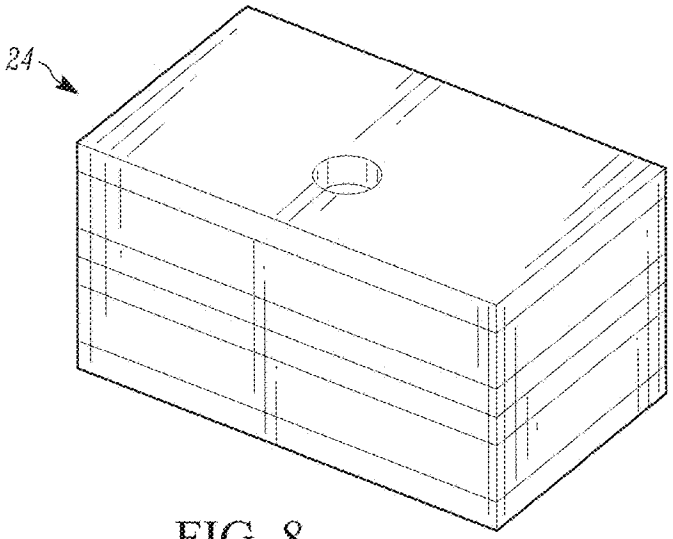
Figure 7:
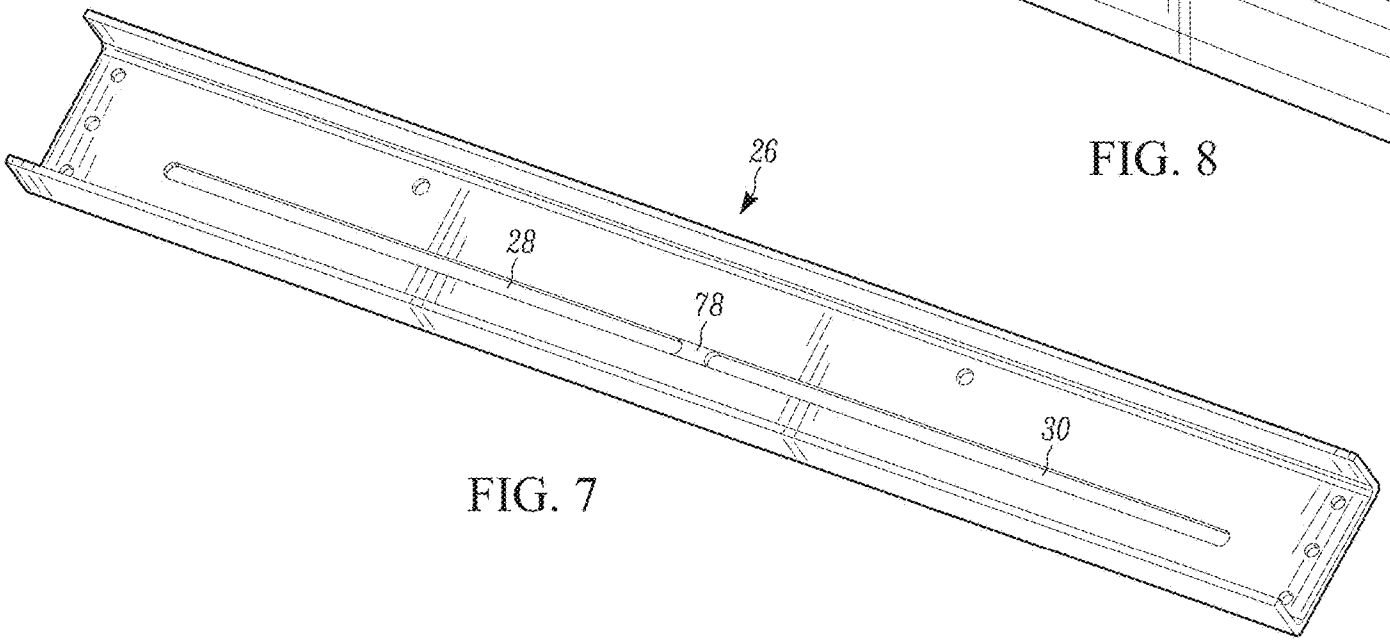

FIG: 4 is a detail view of part of the gas compressor system showing features of slide channels;

FIG. 5 is a detail view of part of the slide channels of FIG. 4 showing the arrangement between a slide channel, an isolator, and a horizontal beam;

FIG. 6 is a perspective view showing a single slide channel;

FIG. 7 is another perspective view of the slide channel shown in FIG. 6;

FIG. 8 is a perspective view showing a single isolator; and

Figure 9:
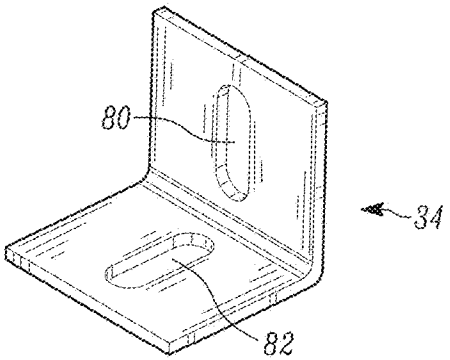

FIG. 9 is a perspective view showing an L-bracket.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements having similar characteristics and operational properties throughout unless otherwise noted. The present disclosure relates to a compressor system 2. The compressor system 2 can be any type of compressor for compressing gases for use in an application such as one or more machines or for storage in a pressure vessel. The compressor system 2 can be used to compress air, nitrogen, and other gases as would be appreciated by those of ordinary skill in the art.

Figure 1:
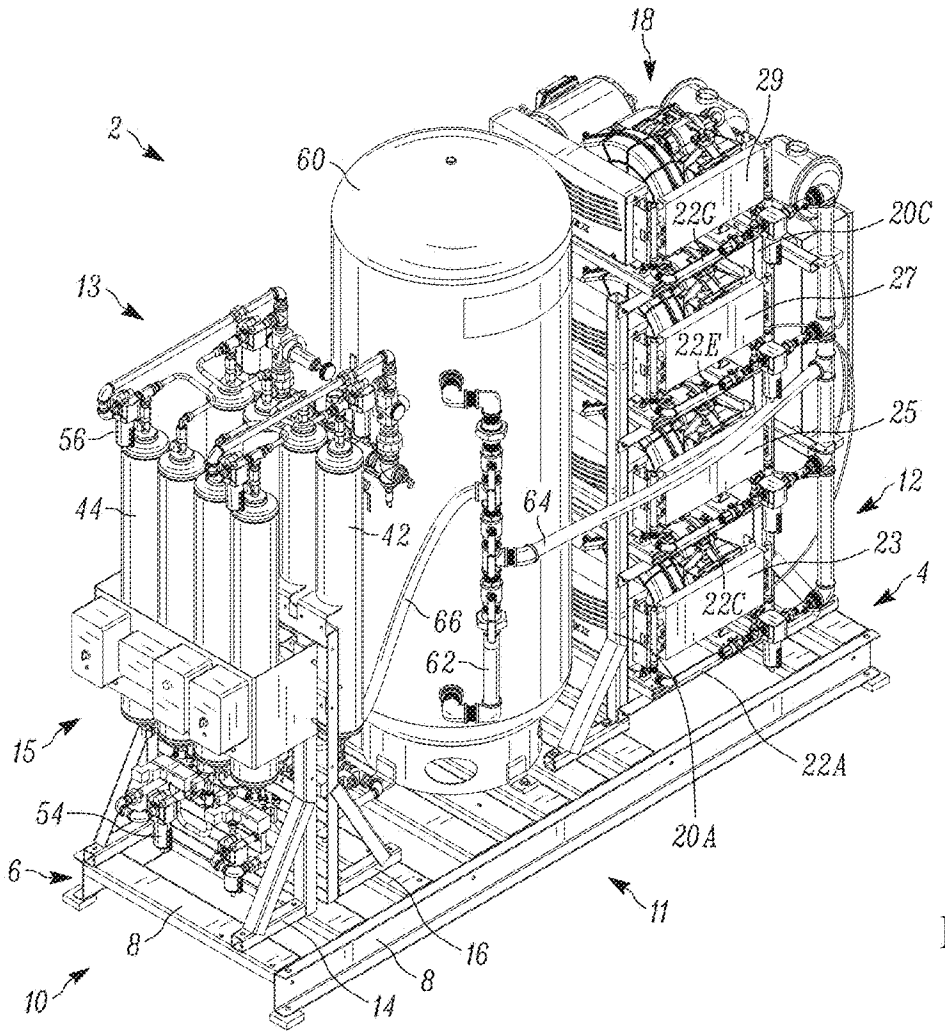
FIG. 1 is a perspective view of an gas compressor system in accordance with on example embodiment of the present disclosure.
Figure 2:
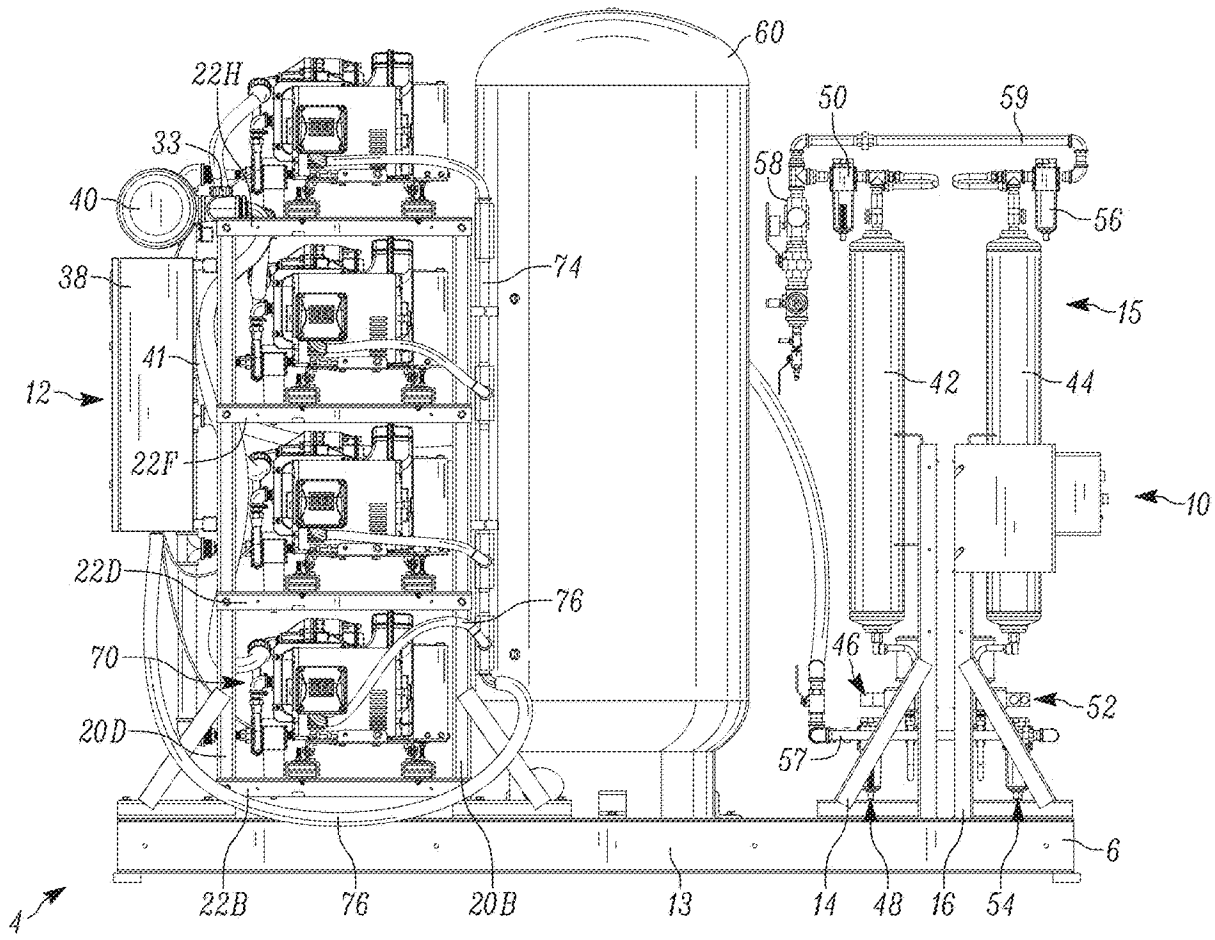
FIG. 2 is a right side view of the gas compressor system of FIG. 1.
Figure 3:
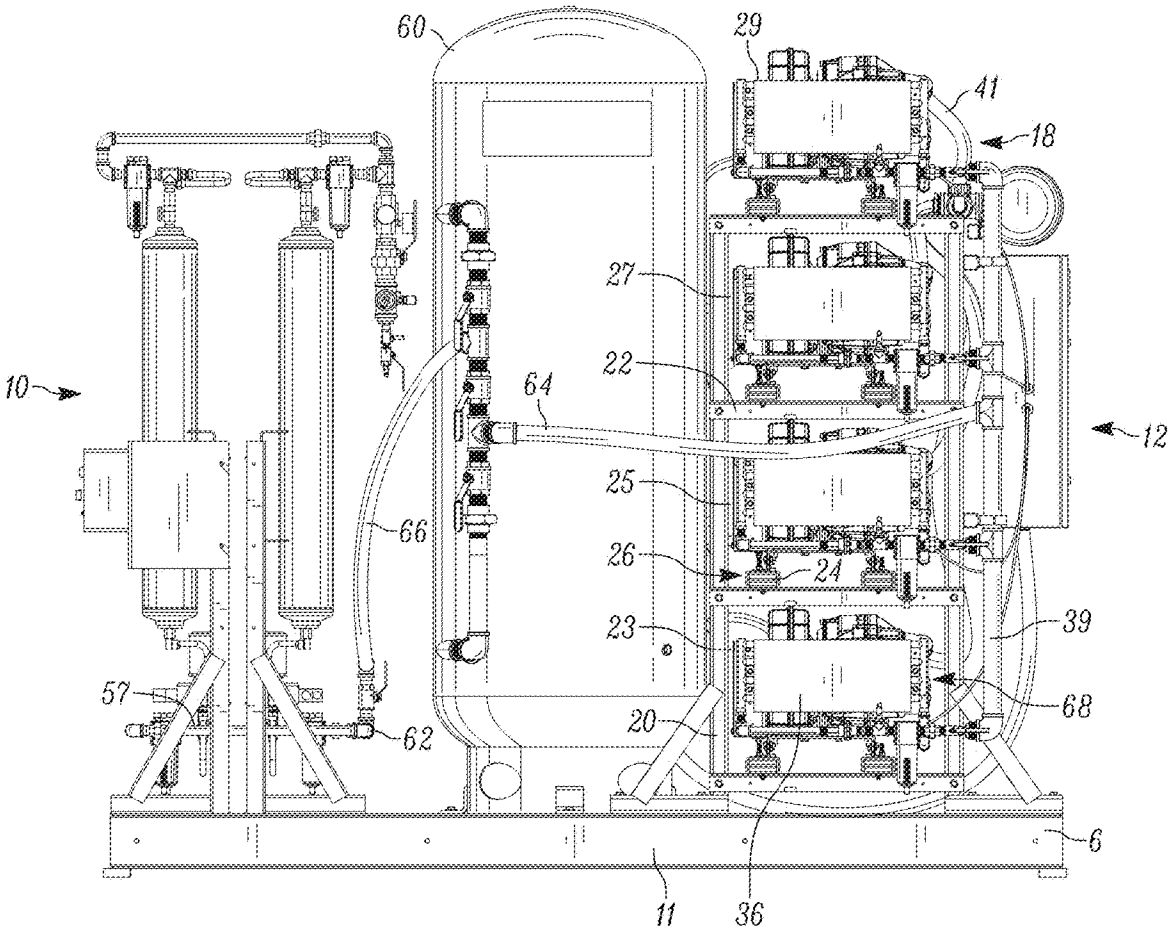
FIG. 3 is a left side view of the gas compressor system of FIG. 1.

With attention directed to FIGS. 1-3, the gas compressor system 2 includes a frame 4. The frame 4 has a base platform 6 that includes platform rails 8. In the example embodiment, the platform rails 8 have a "U"-shaped cross section. However, the platform rails 8 may have any shape cross section that allows for the base platform 6 to have sufficient rigidity and strength to support the compressor system 2. The platform rails 8 are arranged such that the base platform 6 has a substantially rectangular shape when the base platform 6 is viewed from the top down. While in an alternative example embodiment (not shown), the rails 8 are replaced with a single piece of sheet stock that extends the length of the frame 4.

The base platform 6 has a first end 10 and a second end 12, and a left side 11 and a right side 13. It should be understood that the terms "first end"; "second end", "left side", and "right side" are provided only to provide clarity to the description of the compressor system 2 and do not in any way add limitations to the system 2.

A dryer assembly 15 is located toward the first end 10 of the base platform 6. The dryer assembly 15 includes a first support tower 14 and a second support tower 16. In the example embodiment, the first and second support towers 14, 16 are substantially "Y"-shaped, with the two adjacent portions of the "Y" being attached to the base platform 6 and the remaining portion of the "Y" extending perpendicularly away from the base platform 6. The example "Y"-shape of the support towers 14, 16 may be altered to take on any other form that is capable of supporting the components of the compressor system 2 that are attached to and/or supported by the support towers 14, 16.

First and second desiccant dryer tower banks 42, 44 are respectively mounted to the first and second support towers 14, 16. In the example embodiment, the desiccant dryer tower banks 42, 44 each include four individual desiccant dryer towers. However, the compressor system 2 may be provided with fewer or greater desiccant dryer towers to adapt the system 2 for a particular application. Two first pre-filter water separators 48 and two first after filter water separators 50 are provided at opposite ends of the first desiccant dryer tower bank 42. Similarly, two second pre-filter water separators 54 and two second after filter water separators 56 are provided at opposite ends of the second desiccant dryer tower bank 44. Two first switching solenoid valves 46 are interposed between the first pre-filter water separators 48 and the first desiccant dryer tower bank 42, and two second switching solenoid valves 52 are interposed between the second pre-filter water separators 54 and the second desiccant dryer tower bank 44. The first and second pre-filter water separators 48, 54 are attached to an inflow manifold 57. An outflow manifold 59 is attached to the first and second after filter water separators 50, 56. The outflow manifold 59 connects the first and second after filter water separators 50, 56 to an outlet pressure regulator 58.

A compressor tower 18 is located toward the second end 12 of the base platform 6. The compressor tower 18 includes four vertical beams 20A-20D that extend from, and are attached to, the base platform 6. In the illustrated embodiment the vertical beams 20 have a square shaped cross section. However, the vertical beams 20 may have any shape cross section that is capable of supporting components of the compressor system 2 that are attached to the compressor tower 18. The compressor tower 18 is split into four separate support levels 23, 25, 27, 29. Although four separate support levels are shown, the compressor tower 18 may be provided with as many support levels as may be necessary for a particular application. Additionally, it is contemplated that the gas compressor system 2 may only have a single support level. The support levels 23, 25, 27, 29 extend in separate planes that are stacked parallel to one another along the height of the compressor tower 18.

Each of the four support levels 23, 25, 27, 29 has two horizontal beams 22A-H. The horizontal beams 22 are parallel to the base platform 6 and are oriented so as to extend toward the first and second ends 10, 12 of the base platform 6. One set of the horizontal beams 22A, C, E, G interconnects one set of vertical beams 20A, 20C, and the other set of horizontal beams 22B, D, F, H interconnects the other set of vertical beams 20B, 20D. The horizontal beams 22 support slide channels 26A-H. The slide channels 26 have a "U"-shaped cross section. The slide channels 26A-H are oriented so as to extend toward the left and right sides 11, 13 of the base platform 6. As seen in FIGS. 6 and 7, each slide channel 26 has a first slot 28 and a second slot 30. The first and second slots 28, 30 are axially aligned with one another and extend substantially along the length of the slide channel 26. The first and second slots 28, 30 are separated by a limiter 78, in the example embodiment, the limiter 78 is integrally formed with the slide channels 26. However, the limiter 78 may be made separately from the slide channel 26 and subsequently attached by nuts and bolts, welds, or any other suitable fastening means. Additionally, the limiter 78 may be eliminated such that the first and second slots 28, 30 form a single continuous slot.

The compressor tower 18 further includes a plurality of isolators 24A-P. The isolators 24 are interposed between the horizontal beams 22 and the slide channels 26. As can be clearly seen in FIG. 8, the example isolators 24 have a substantially cuboid shape and are dimensioned so as to substantially occupy the space between where the slide channels 26 overlap, and are supported by, the horizontal beams 22 as illustrated in the example embodiment of FIGS. 4 and 5. The example isolators 24 are made up of alternating layers of different isolating material. Any other suitable isolator may be substituted for the isolator shown in FIG. 8. For example, the isolators 24 may be cylindrical shaped and made up of a single material. Isolator fasteners 31 extend through the slide channels 26, the isolators 24, and the horizontal beams 22. The isolator fasteners 31 secure the slide channels 26 to the horizontal beams 22, and further secure the isolators 24 in between the slide channels 26 and the horizontal beams 22.

In one example embodiment the isolators 24 are made integrally formed of two different materials. Two such suitable materials include cork and rubber. However, other examples of suitable materials include fibrous material, polymeric material, synthetic rubber, or any combination thereof.

Each of the four support levels 23, 25, 27, 29 further has a compressor support platform 32A-D. The compressor support platforms 32 are supported by the slide channels 26. As can be clearly seen in FIGS. 4 and 5, the compressor support platforms 32 are provided with L-brackets 34. As can be seen in FIG. 9, each L-bracket 34 has a first elongated slot 80 on a first portion and a second elongated slot 82 on a second portion. Essentially, the L-bracket 34 has two portions that mirror one another. Height adjustment fasteners 35 extend through the first elongated slot 80 to secure the first portion of the L-brackets 34 to the compressor support platforms 32. Sliding fasteners 37 extend through the second elongated slot 82 to secure the second portion of the L-brackets 34 to the to the slide channels 26. The fasteners 35, 37 and L-brackets cooperate to secure the compressor support platforms 32 to the slide channels 26. The sliding fasteners 37 extend through the L-brackets 34 and the slide channels 26 such that part of the sliding fastener 37 extends through the first or second slots 28, 30 of the slide channels 26.

A compressor 36A-D is mounted to each of the compressor support platforms 32. Each compressor 36 includes a compressor 68 and a motor 70, in the example embodiment the compressors 36 are mounted on the compressor support platforms 32 such that the compressor 68 is toward the left side 13 of the base platform 6, and the motor 70 is toward the right side 11. However, the compressor 36 may be mounted on the support platform 32 in any other suitable orientation. Additionally, in the example embodiment the compressors 36 are 7.5 horsepower scroll compressor pumps driven by the motors via belt. However, other compressor sizes and types may be mounted to the compressor support platforms 32. Furthermore, it is contemplated that other types of components which orbit, reciprocate, rotate, or otherwise would benefit from vibration isolation could be mounted to the compressor support platforms 32.

In an alternative example embodiment, the support platform 32 includes a planar surface spaced at both ends by a flange collectively forming a single slide channel 26 for supporting the respective compressors 36. The support platform 32 with the flanged ends would have similar strength and rigidity as the example embodiments of FIG. 4 despite being a single slide channel 26 integrally formed with a platform 32.

A control panel 38 and intake filter 40 are mounted to the compressor tower 18 toward the second end 12 of the base platform 6. The intake filter 40 is provided with a distribution manifold 33. The four compressors 36 are connected to the distribution manifold 33 by inlet hose 41. The four compressors 36 are provided with an outlet manifold 39. The outlet manifold 39 is mounted to the compressor tower 18 toward the left side 11 of the base platform 6. A cable router 74 is mounted to the compressor tower 18 toward the right side 13 of the base platform 6. Cable 76 runs from the control panel 38 and is directed by the cable router 74 to each of the four compressors 36. The cable 76 carries electricity to power the compressor 36 motor 70, and may also carry data lines which supply control information to the compressor 36.

A receiver tank 60 is mounted to the base platform 6 in-between the dryer assembly 15 and the compressor tower 18. In the example embodiment the receiver tank 60 has a 200 gallon capacity. However, the 200 gallon receiver tank 60 may be replaced with whatever capacity receiver tank may needed for a particular application. The receiver tank 60 is provided with a receiver tank manifold 62. A receiver tank inlet hose 64 connects a first portion of the receiver tank manifold 62 to the outlet manifold 39 of the compressors 36. A receiver tank outlet hose 66 connects a second portion of the receiver tank manifold 62 to the inflow manifold 57 of the desiccant dryer tower banks 42, 44.

Referring now to FIGS. 1-3, the basic operation of the compressor system 2 will now be explained. First, gas is drawn into the intake filter 40 and is distributed to the compressors 36 via the distribution manifold 33 and the inlet hose 41. The motor 70 powers the compressor 68 thereby causing the compressors 36 to compress the gas. The compressed gas exits the compressors 36 and is directed into the receiver tank 60 via the outlet manifold 39, the receiver tank inlet hose 64, and the first portion of the receiver tank manifold 62. The receiver tank 60 stores the compressed gas under pressure until the compressed gas is needed to operate equipment. When the need to operate equipment arises, the compressed gas is directed out of the receiver tank 60, through the second portion of the receiver tank manifold 62 and receiver tank outlet hose 66, and into the dryer assembly 15 through the inflow manifold 57. The compressed gas travels through the dryer assembly 15 via the intake manifold 57, the pre-filter water separators 48, 54, the gas-switching solenoid valves 46, 52, the desiccant dryer towers 42, 44, the after filter water separators 50, 56, the outflow manifold 59 and the outlet pressure regulator 58. From the outlet pressure regulator 58 the compressed gas is distributed to the equipment which needs compressed gas for operation.

The gas compressors 36 may vibrate during normal operation. The isolators 24 limit the transmission of gas compressor 36 vibration to other parts of the gas compressor system 2 and also to areas outside the gas compressor system 2. Thus, the isolators 24 provide a quieter and potentially more robust gas compressor system 2. The arrangement of the isolators 24 and the slide channels 26 allows for improved access to the compressors 36 while also still maintaining the aforementioned vibration isolation.

With attention directed to FIGS. 1-5 and especially FIGS. 4 and 5, the process by which the compressors 36 may be accessed to ease maintenance will now be described. First, it must be decided whether it is desired to perform maintenance on the compressor 68 or the motor 70 of the gas compressor 36. For the purposes of discussion, the following process will be described in regard to gaining access to the compressor 68. As explained above, the example embodiment of the gas compressor system 2 has the gas compressors 36 mounted such that the compressor 68 is toward the left side 14 of the base platform 6. As such, easing access to the compressor 68 may be accomplished by moving the gas compressor toward the left side 14 of the base platform 6. The process of moving the gas compressor 36 begins with removing the sliding fasteners 37 that extend through the second elongated slot 82 of the L-brackets 34 that are located toward the left side 14 of the base platform 6. Next, the height adjustment fasteners 35 extending through the first elongated slot 80 of the same L-brackets 34 are loosened. The first elongated slot 80 permits the L-brackets 34 to move relative to the compressor support platform once the height adjustment fasteners 35 are loosened. The L-brackets 34 may then be positioned such that the second portion of the L-brackets 34 is spaced apart from the slide channels 26. The height adjustment fasteners 35 are then tightened, thereby maintaining the position of the L-brackets 34 spaced apart from the slide channels 26. Next, the sliding fasteners 37 extending through the second elongated slot 82 of the L-brackets 34 that are located toward the right side 13 of the base platform 6 are loosened, but not removed. With the sliding fasteners 37 toward the right side 13 of the base platform 6 loosened and the sliding fasteners 37 toward the left side 14 removed, the compressor support platform 32 is now free to slidably move relative to the slide channels 26 toward the left side 15 of the base platform 6. As the compressor support platform 32 is slid toward the left side 11, the L-brackets 34 located toward the left side 11 are able to pass over the isolator fasteners 31 that secure the slide channels 26 to the horizontal beams 22 due to the above described operation of spacing the L-brackets 34 apart from the slide channels 26. Contact between the loosened sliding fasteners 37 and the limiter 78 prevents the compressor support platform 32 from being slid too far away from the compressor tower 18. Additionally, the loosened fasteners 37 prevent the compressor support platform 32 from tipping and completely separating away from the compressor tower 18. With the gas compressor 36 slid toward the left side 11 of the base platform the compressor 68 is better presented for easier access for maintenance. Optionally, once the compressor support platform 32 is slid to a desired location, the loosened fasteners 37 may be retightened to securely maintain the compressor support platform 32 in the desired location.

The process of returning the compressor support platform 32 to the initial position is substantially the reverse of the above described process. It is clear that a similar operation could be performed to allow the support platform 32 to slide toward the right side 13 of the support base platform 6 in order to gain better access to the gas compressor 36 motor 70.

The gas compressor system 2 may be provided with additional isolators to further limit the transmission of vibration. For example, as can be seen in FIGS. 1-3, the base platform 6 may be provided with isolator feet 7A-D, which space the base platform 6 apart from the ground. Additionally, mounting isolators 84 may be used to mount the outlet manifold 39 and the cable router 74 to the compressor tower 18.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a ", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected or in contact, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A gas compressor storage system comprising:

at least one support level, the at least one support level comprising:

at least two slide channels supported by at least two beams, the at least two slide channels secured to said at least two beams;

a platform slidably attached to said at least two slide channels via first and second slots defined by each of the at least two slide channels, the first and second slots allowing translation of said platform from a resting position to a first service position, and from said resting position to a second service position, the first service position being in an opposite direction of said second service position, the platform translating through said resting position when passing from the first to second service positions, wherein a limiter spaces the first slot from the second slot along each of the at least two slide channels;

an isolator disposed between each of the at least two slide channels and the at least two beams, the isolators spacing the at least two slide channels from the at least two beams, respectively; and at least one compressor mounting area and one motor mounting area located on the platform wherein at least one of the compressor mounting area and the motor mounting area are in a position to allow service of a compressor or motor, respectively, when in at least one of the first service position and the second service position.

2. The gas compressor storage system of claim 1, wherein said at least two slide channels are connected by said at least two beams.

3. The gas compressor system storage of claim 2, wherein the first and second slots extend along the length of each of the at least two the slide channels and wherein each slot comprises a guide for the slidable attachment of the platform to the at least two slide channels.

4. The gas compressor storage system of claim 3, wherein the first and second slots are axially aligned with one another and separated along the length of each of the at least two slide channels by the limiter.

5. The gas compressor storage system of claim 4, wherein the isolator is made up of at least two different vibration isolation materials.

6. The gas compressor storage system of claim 3, wherein the gas compressor system includes a plurality of support levels, the plurality of support levels being arranged to form a compressor tower.

7. The gas compressor storage system of claim 3, wherein the isolator is made up of at least two different vibration isolation materials.

8. The gas compressor storage system of claim 2, wherein each of the at least two slide channels has a u-shape, and wherein the isolators are between three inwardly facing sides of each of the at least two slide channels, respectively.

9. The gas compressor storage system of claim 8, comprising the first and second slots extending along the length of each of the at least two slide channels, the first and second slots being axially aligned with one another and separated along the length of each of the at least two slide channels by the limiter and wherein the gas compressor system includes a plurality of support levels, the plurality of support levels being arranged to form a compressor tower.

10. The gas compressor storage system of claim 2, wherein the gas compressor system includes a plurality of support levels, the plurality of support levels being arranged to form a compressor tower.

11. The gas compressor storage system of claim 10, wherein the isolator is made up of at least two different vibration isolation materials.

12. The gas compressor storage system of claim 2, wherein a securing fastener transects each of:

one of the at least two beams;

one of the at least two slide channels to secure the at least two slide channels to the at least two beams; and the corresponding isolator between the one of the at least two beams and the one of the at least two slide channels.

13. A gas compressor system comprising:

at least one receiver tanks;

at least two support levels, each of the two support levels comprising:

at least two u-shaped slide channels supported by at least two beams, the at least two u-shaped slide channels comprising two lateral walls connected by a transverse wall;

a platform slidably attached to the at least two u-shaped slide channels via first and second slots defined by each of the at least two slide channels, the first and second slots allowing translation of said platform from a resting position to a first service position, and from said resting position to a second service position, the first service position being in an opposite direction of said second service positon, the platform translating through said resting positon when passing from the first to second service positions, wherein a limiter spaces the first slot from the second slot along each of the at least two slide channels;

an isolator disposed between each of the at least two u-shaped slide channels and the at least two beams, wherein the isolator is located between the two lateral walls of the u-shaped slide channel; and a compressor mounted to the platform; and at least one removably located fastener positioned within each of the first and second slots, each of the removably located fasteners for slidably securing said platform to said slide channels.

14. The gas compressor system of claim 13 further comprising at least four couplers secured to each platform with a platform fastener at a first end of said coupler and a second end of said coupler slidably secured to one of said at least two slide channels by said removably located fasteners.

15. The gas compressor system of claim 14 wherein said first end and said second end of said couplers are substantially orthogonal.

16. The gas compressor system of claim 13 wherein the isolator is made up of at least two different vibration isolation materials.

17. A gas compressor system comprising:

at least one compressor mounted to a platform;

at least one support level comprising:

at least two slide channels supported by at least two beams, wherein the slide channels comprise a U-shape having three internally facing surfaces;

the platform slidably attached to the at least two slide channels via slots defined by the at least two slide channels; and an isolator disposed between the three internally facing surfaces of each of the at least two slide channels and the at least two beams, wherein a side of each isolator is in contact with one of the three internally facing surfaces of the slide channels;

an L-bracket coupled to at least one removably located fastener positioned within at least one slot of the slots defined by each of the at least two slide channels, the L-bracket additionally coupled to a height adjustment fastener to secure the platform to the L-bracket, wherein said L-bracket is vertically movable via the height adjustment fastener; and each slot of the slots extending axially along the respective slide channel and parallel with one another, each slot further comprising a limiter positioned within each slot to form first and second portions of said slot, the slots allowing translation of said platform from a resting position to a first service position, and from said resting position to a second service position, the first service position being in an opposite direction of said second service position, the platform translating through said resting position when passing from the first to second service positions, wherein the limiter spaces the first portion of each slot from the second portion of each slot and interacts with the platform when said platform is in said first service position and said second service position, wherein the platform is in a position to allow service of a supported compressor or motor when in at least one of the first service position and the second service position.

18. The gas compressor system of claim 17, comprising the at least one removably located fastener positioned within the first and second portions of each slot, each of the removably located fasteners for slidably securing said platform to said slide channels and wherein each slot comprises a guide for the slidable attachment of the platform to the at least two slide channels.

19. The gas compressor system of claim 18, further comprising at least four of the L-brackets secured to each platform with the height adjustment fastener at a first end of each L-bracket and a second end of each L-bracket slidably secured to one of said at least two slide channels by said at least one removably located fastener.

20. The gas compressor system of claim 17, wherein a securing fastener transects each of:

one of the at least two beams;

one of the at least two slide channels to secure the at least two slide channels to the at least two beams; and the corresponding isolator between the one of the at least two beams and the one of the at least two slide channels.

21. The gas compressor system of claim 17, wherein the gas compressor system includes a plurality of support levels, the plurality of support levels being arranged to form a compressor tower.

* * * * *